United States Patent [19]

Quack

[11] Patent Number: 4,924,677

[45] Date of Patent: May 15, 1990

[54] METHOD AND INSTALLATION FOR COOLING AN APPARATUS

[75] Inventor: Hans Quack, Pfaffikon, Switzerland

[73] Assignee: Sulzer Brothers Limited, Winterthur, Switzerland

[21] Appl. No.: 308,263

[22] Filed: Feb. 9, 1989

[30] Foreign Application Priority Data

Mar. 18, 1988 [CH] Switzerland ..... 1034/88

[51] Int. Cl.[5] ..... F25B 9/00

[52] U.S. Cl. ..... 62/87; 62/434

[58] Field of Search ..... 62/87, 88, 434

[56] References Cited

U.S. PATENT DOCUMENTS

| | | | |
|---|---|---|---|
| 2,394,109 | 2/1946 | Sanchez | 62/126 |
| 2,737,032 | 3/1956 | Latham | 62/117.55 |
| 3,194,026 | 7/1965 | La Fleur | 62/513 |
| 3,214,938 | 11/1965 | Zotos | 62/513 |
| 3,321,930 | 5/1967 | La Fleur | 62/87 |
| 3,355,903 | 12/1967 | La Fleur | 62/88 |
| 3,992,891 | 11/1976 | Pocrnja | 62/87 |
| 4,304,099 | 12/1981 | Vakil | 62/86 |
| 4,461,154 | 7/1984 | Allam | 62/87 |

FOREIGN PATENT DOCUMENTS

| | | |
|---|---|---|
| 1451004 | 3/1969 | Fed. Rep. of Germany . |
| 1113372 | 3/1956 | France . |
| 2544376 | 10/1984 | France . |
| 0340849 | 10/1959 | Switzerland . |
| 0591055 | 8/1977 | Switzerland . |
| 0882212 | 11/1961 | United Kingdom . |
| 1288039 | 9/1972 | United Kingdom . |

*Primary Examiner*—Ronald C. Capossela

*Attorney, Agent, or Firm*—Kenyon & Kenyon

[57] ABSTRACT

The cooling circuit for cooling a computer in a room employs a work-performing expansion. The heat generated by the expansion is supplied to the back flowing coolant in the coolant circuit via a second closed coolant circuit. The second circuit may employ a cooler outside the room to withdraw the heat added to the second circuit.

10 Claims, 1 Drawing Sheet

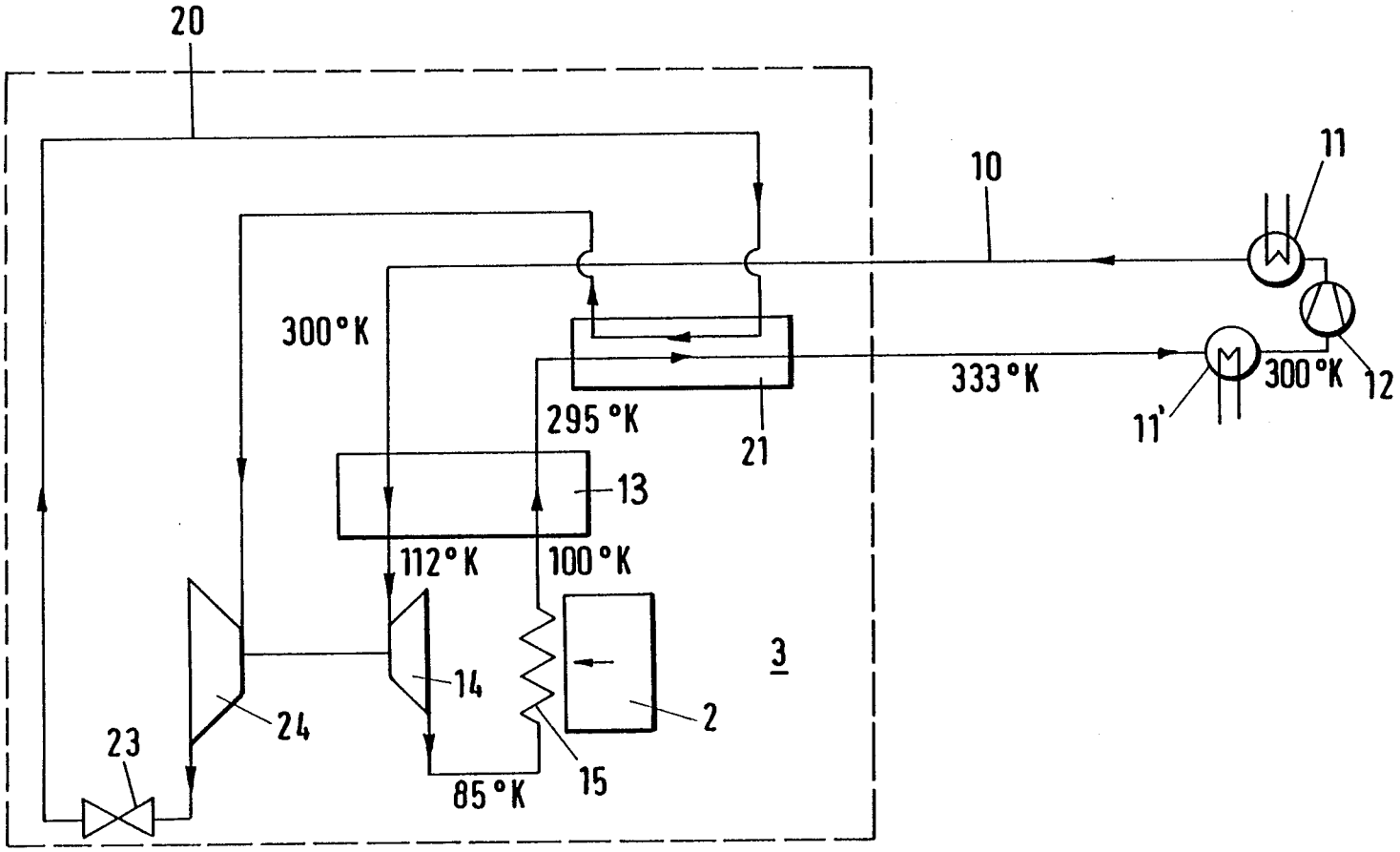
11
12
300°K
11'
10
333°K
21
3
2
295°K
13
100°K
15
85°K
14
112°K
300°K
24
20
23

METHOD AND INSTALLATION FOR COOLING AN APPARATUS

This invention relates to a method and an installation for cooling an apparatus. More particularly, this invention relates to a method and an installation for cooling computers in air-conditioned rooms.

Heretofore, various techniques have been known for the cooling of an apparatus by means of a coolant flowing through a circuit in which "cold" is produced by work-performing expansion of the coolant. For example, U.K. Patent No. 1,288,039 describes a cooling system which employs an expansion turbine for expanding and cooling a gas and U.K. Patent No. 882,212 described a cold gas expansion refrigeration machine which serves for cold production by work-delivering expansion. The work-performing expansion of the coolant can occur, for example, by the Claude or by the Brayton process. The Claude process is described for example in the textbook TIEFTEMPERATURTECHNIK (Low Temperature Technology), H. Hausen and H. Linde, second edition 1985, Springer-Verlag Berlin, Heidelberg, N.Y., Tokyo, on pages 88 ff. A description of the Brayton process appears for example in the textbook TIEFTEMPERATURTECHNOLOGIE, F. X. Eder, VDI-Verlag 1981.

In addition, installations are known, in particular, low-temperature refrigeration or cooling installations, wherein heat is produced in the immediate vicinity of a refrigerating group, for example in the so-called brake compressor of a hydraulic brake or of an eddy current brake. This heat is then given off, for example, to the surrounding atmosphere or is carried away with the coolant in an independent cooling circuit.

For example, U.S. Pat. No. 2,394,109 describes a cooling apparatus wherein the velocity energy of a refrigerant passing through an expansion value is used for driving an air circulating means within a chamber in which the refrigerating apparatus is mounted.

U.S. Pat. No. 2,737,032 described a refrigeration system wherein a cooled compressed refrigerant gas is passed through a load and thereafter expanded into countercurrent out-of-contact heat exchange relation with the compressed gas prior to passage into the load. By cooling the gas to refrigeration temperature, then passing the gas through the load before expanding, the temperature of the gas is first raised during passage through the load and then cooled by expansion to a temperature only low enough to be effective to cool the compressed gas to refrigeration temperature in a heat exchanger.

U.S. Pat. No. 4,304,099 describes a refrigeration cycle wherein a portion of available expansion work is recovered through a transfer of heat from expanding working fluid to vapor flowing in a compressor suction line.

However, a direct transfer of heat to the environment surrounding the apparatus to be cooled may lead to an undesired temperature rise. In air conditioned rooms, the additional heat leads to an increased load on the air conditioner. This increased load may be 20 kW and more. This leads, in turn, to problems particularly where the cooling installation is to be installed in an air-conditioned room at a later time, as subsequent alternations in an air-conditioning installation are possible only at disproportionately high engineering and financial cost.

The installation of an independent cooling circuit for the removal of heat may also present difficulties, especially in air-conditioned rooms containing highly sensitive equipment, such as high-performance computers. Water cooling, for example, which would in itself be possible for the removal of heat from computer parts operated in the low-temperature range of about 180° K. or lower is not desirable.

Accordingly, it is an object of the invention to be able to remove heat generated in a work-performing expansion of a coolant in a simple reliable manner.

It is another object of the invention to be able to efficiently cool a computer in an air conditioned room.

It is another object of the invention to provide a cooling installation in which heat generated during work expansion of a coolant can be readily removed and efficiently used.

It is another object of the invention to provide a relatively simple technique for cooling an apparatus in an environment where the removal of heat is difficult.

Briefly, the invention provides a method for cooling an apparatus which includes the steps of directing a coolant through a closed circuit, subjecting the coolant in the circuit to a work-performing expansion in order to cool the coolant and generate work, passing the cooled coolant in the circuit into heat exchange relation with the apparatus in order to cool the apparatus while transferring heat to the coolant and transferring the work generated during expansion in the form of heat to the coolant in the circuit downstream of the apparatus.

The invention also provides an air-conditioning installation which comprises a cooling circuit for a coolant having means for work-performing expansion of the coolant to cool the coolant while generating work, a first heat exchanger downstream of the expansion means for cooling an apparatus while heating the coolant and a second heat exchanger downstream of the first heat exchanger. In addition, the installation includes a means for transferring the generated work in the form of heat to the second heat exchanger in order to heat the coolant passing therethrough. This latter means may include a second circuit have a coolant therein wherein the second circuit is disposed in heat exchange relation with the second heat exchanger.

The expansion means used in the coolant circuit may be a turbine operative on either a Claude process or a Brayton process. In addition, the installation may include a cooler in the circuit downstream of the second heat exchanger for cooling the coolant. In this case, the coolant serves to withdraw heat from the coolant in the order of magnitude of the heat generated during expansion.

The cooling installation may be particularly used for cooling a computer within an air-conditioned room. In this case, the heat which is generated during expansion of the primary coolant is utilized in the coolant circuit rather than being transferred into the environment surrounding the computer.

The method of cooling and the cooling installation permit the cooling of apparatus in a simple manner and at relatively simple cost, particularly in sites where heat removal may be critical. Moreover, cooling installations which operate as described do not remain thermoactive for the surrounding environment of a turbine or of a piston which furnishes the cooling power by work-performing expansion. Thus, the installation is very favorable when used in air-conditioned rooms.

These and other objects and advantages of the invention will become more apparent from the following detailed description taken in conjuction with the accompanying drawing wherein:

The drawing schematically illustrates an air conditioned room employing a cooling installation in accordance with the invention.

As illustrated, the air-conditioned room 3 contains an apparatus such as a computer 2 which requires cooling. To this end, a cooling installation is provided with employs a cooling circuit 10 for cooling the apparatus 2.

The cooling circuit 10 contains a coolant and includes a pair of cooler 11, 11' and a compressor 12 outside the room 3. In addition, a heat exchanger 13 is disposed within the room 3 along with a means, such as a turbine 14, for conducting a work-performing expansion of the coolant as well as a heat exchanger or cooler 15 for placing the coolant in heat exchange relation with the apparatus 2. A second heat exchanger 21 is also disposed downstream of the apparatus 2 and the heat exchanger 13 in the return line of the circuit to the outside cooler 11'.

When in operation, coolant flows through the heat exchanger 13 and is cooled by the counter-flowing coolant therein. The cooled coolant then passes through the turbine 14 and is expanded while being further cooled to a suitable cooling or operating temperature while work is generated. The coolant then passes through the heat exchanger 15 in heat exchange relation with the apparatus 2 so as to be heated while the apparatus 2 is cooled. The coolant then flows back through the heat exchangers 13, 21 to the cooler 11' and compressor 12.

The cooling installation also includes a second closed circuit 20 within the room 3 which acts as a means for transferring the generated work due to the expansion of the coolant in the first circuit 10 in the form of heat to the heat exchanger 21 in order to heat the coolant passing therethrough. The second circuit 20 includes a brake turbine 24 drivingly connected to the turbine 14 of the first circuit 10 to be driven thereby and a throttle 23. When in operation, the second coolant is heated by the work performed at the brake turbine 24 and is supplied via the throttle 23 to the heat exchanger 21 where the heat is transmitted to the backflowing coolant of the cooling circuit 10. Thus, the expansion work transformed into heat by the brake compressor turbine 24 does not cause any temperature rise in the room 3.

The cooler 11' of the first closed circuit 10 is expediently dimensioned to withdraw heat in the order of magnitude of the heat generated during expansion. Thus, the amount of heat supplied to the return pass of the cooling circuit 10 in the heat exchanger 21 is approximately withdrawn outside this room 3. This construction is particularly suitable, for example, when expanding an existing cooling installation with a closed cooling circuit.

In an alternative construction, the cooler 11 and compressor 12 can be selected so that the cooler 11' may be omitted.

By way of example, the temperature data for the two cooling circuit 10, 20 are shown at different points in the drawing to indicate possible conditions in a low-temperature cooling installation as used, for example, for state-of-the-art high performance computers. Under these temperature conditions, nitrogen would be suitable as a coolant both cooling circuits 10, 20.

The invention thus provides a method and installation for efficiently using the heat generated during a work-performing expansion of a coolant in a closed circuit.

Further, the invention provides a technique for avoiding the heating of a room by a cooling apparatus used for cooling a computer. In particular, the cooling installation provides no heat load for the immediate surroundings of the cooling installation and may be used for the cooling of high performance computer, particularly in rooms in which heat removal is a delicate problem such as in air conditioned rooms.

What is claimed is:

1. A method for cooling an apparatus comprising the steps of directing a coolant through a closed circuit;

subjecting the coolant in the circuit to a work-performing expansion to cool the coolant and to generate work;

passing the cooled coolant in the circuit into heat exchange relation with the apparatus to cool the apparatus while transferring heat to the coolant; and transferring the work generated during expansion in the form of heat to the coolant in the circuit downstream of the apparatus.

2. A method as set forth in claim 1 wherein said transferring step includes directing a second coolant through a second closed circuit to absorb the heat generated during expansion and to transfer the absorbed heat to the first coolant in heat exchange relation therewith.

3. A method as set forth in claim 1 which further comprises the step of cooling the coolant in said circuit downstream of the apparatus to withdraw heat in the order of magnitude of the heat generated during expansion.

4. A cooling installation comprising a cooling circuit for a coolant having means for work-performing expansion of the coolant to cool the coolant while generating work, a first heat exchanger downstream of said means for cooling an apparatus while heating the coolant and a second heat exchange downstream of said first heat exchanger; and second means for transferring the generated work in the dorm of heat to said second heat exchanger to heat the coolant passing therethrough.

5. An installation as set forth in claim 4 wherein said second means includes a second circuit having a second coolant therein disposed in heat exchange relation with said second heat exchanger and having a brake turbine drivingly connected to said means for work-performing expansion to transfer said work into heat.

6. An installation as set forth in claim 5 wherein said expansion means is a turbine operable on one of a Claude process and a Brayton process.

7. An installation as set forth in claim 4 which further comprises a cooler in said circuit downstream of said second heat exchanger for cooling the coolant.

8. In combination an air-conditioned room having a computer therein; and a cooling installation for cooling said computer, said installation including a cooling circuit for a coolant having means for work-performing expansion of the coolant to cool the coolant while generating work, a first heat exchanger downstream of said means for cooling said computer while heating the coolant and a second heat exchanger downstream of said first heat exchanger; and second means for transferring the generated work in the form of heat to said second heat exchanger to heat the coolant passing therethrough.

9. The combination as set forth in claim 8 wherein said second means includes a second circuit having a second coolant therein disposed in heat exchange relation with said second heat exchanger and having a brake turbine drivingly connected to said means for work-performing expansion to transfer said work into heat.

10. The combination as set forth in claim 8 wherein said installation includes a cooler outside said room downstream of said second heat exchanger for cooling the coolant.

* * * * *

UNITED STATES PATENT AND TRADEMARK OFFICE
CERTIFICATE OF CORRECTION

PATENT NO. : 4,924,677

DATED : May 15, 1990

INVENTOR(S) : HANS QUACK

It is certified that error appears in the above-identified patent and that said Letters Patent is hereby corrected as shown below:

Column 1, line 16 "described" should be --describes--

Column 3, line 48 cancel "compressor"

Column 4, line 43 "exchanged" should be --exchanger--

Column 4, line 45 "dorm" should be --form--

Signed and Sealed this

Twelfth Day of November, 1991

*Attest:*

HARRY F. MANBECK, JR.

*Attesting Officer*

*Commissioner of Patents and Trademarks*